US006287078B1

(12) United States Patent
Min et al.

(10) Patent No.: US 6,287,078 B1
(45) Date of Patent: Sep. 11, 2001

(54) AXIAL FLOW FAN

(75) Inventors: Ok Ryul Min; Kyung Seok Cho, both of Taejon-si (KR)

(73) Assignee: Halla Climate Control Corp. (KR)

( * ) Notice: Subject to any disclaimer, the term of this patent is extended or adjusted under 35 U.S.C. 154(b) by 0 days.

(21) Appl. No.: 09/475,631

(22) Filed: Dec. 30, 1999

(30) Foreign Application Priority Data

Dec. 31, 1998 (KR) ..... 98-0064148
Dec. 7, 1999 (KR) ..... 99-0055565

(51) Int. Cl.[7] ..... F04D 29/38

(52) U.S. Cl. ..... 416/189; 416/238; 416/DIG. 2; 416/DIG. 5

(58) Field of Search ..... 416/169 A, 189, 416/192, 223 R, 238, 243, DIG. 2, DIG. 5

(56) References Cited

U.S. PATENT DOCUMENTS 4,548,548 * 10/1985 Gray, III ..... 416/189
4,569,631 * 2/1986 Gray, III ..... 416/189
4,684,324 * 8/1987 Perosino ..... 416/189
5,273,400 * 12/1993 Amr ..... 416/189
5,393,199 * 2/1995 Alizadeh ..... 416/189
5,996,685 * 12/1999 Alizadeh ..... 416/169 A

* cited by examiner

*Primary Examiner*—Christopher Verdier

(57) ABSTRACT

An axial flow fan is disclosed. The axial flow fan comprises a hub, a plurality of blades extending radially outwardly from the hub, and an outer band surrounding peripheral ends of the blades. The median sweep angle of each blade increases gradually from 0° along the outward radial direction. The leading sweep angle of each blade starts from an angle of less than 0°, increases gradually and terminates at an angle of more than 40°. The trailing sweep angle of each blade increases along the outward radial direction after it decreases from an angle of more than 0° along the outward radial direction. The chord length of each blade gradually increases along the outward radial direction. The pitch angle of each blade gradually decreases along the outward radial direction.

19 Claims, 8 Drawing Sheets

AXIAL FLOW FAN

BACKGROUND OF THE INVENTION

1. Field of the Invention

The present invention relates, in general, to axial flow fans for moving air axially by rotating a plurality of identical blades extending from a central hub and, more particularly, to an axial flow fan having a high efficiency and generating low noise because the sweep angle, the chord length and the pitch angle of each of the blades are designed to be harmonized.

2. Description of the Prior Art

As well known to those skilled in the art, an axial flow fan consists of a central hub and a plurality of blades extending from the hub, and moves air axially by means of the rotating blades while being rotated by the rotating force transmitted from a power source to the hub. The axial flow fan serves to blow air forcibly to a heat exchanger so as to promote heat radiation from engine cooling water or air-conditioner coolant that is circulated through the heat exchanger, such as a radiator or a condenser.

Generally, the axial flow fan is provided with a shroud that surrounds the blades and is fixed to a heat exchanger. The shroud serves to guide air moved by the rotation of the blades so as to blow a larger amount of air to the heat exchanger and also is used to support a motor that generates driving force to rotate the blades.

A conventional axial flow fan comprises a central hub connected with the driving shaft of a motor, a plurality of blades extending radially outwardly from the hub, and an outer band to which the peripheral ends of the blades are fixed. The axial flow fan is generally made of synthetic resin and formed into a single body. The fan band allows the blades to be restrained within the fan band by connecting the side edges of the blades, thereby preventing the blades from being deformed.

In the construction of the axial flow fan, the blades are directly concerned with the movement of air. Each of the blades has a streamlined cross section functioning to draw air from the front of the axial flow fan using pressure increase through the pressure face due to the rotation of the blades and to push the drawn air toward the rear of the axial flow fan.

With regard to design for such an axial flow fan, the below-mentioned limitations follow.

Since the axial flow fan may be used to cool a radiator for cooling an engine and a condenser for improving the performance of an air-conditioner, the axial flow fan should generate a sufficient amount of airflow necessary for the cooling while overcoming a drop in positive pressure due to the loads of the heat exchangers. Additionally, since a vehicle is provided with many electronic devices and the devices consume a large amount of energy, a blowing efficiency with regard to the quantity of power that the electric motor of the fan consumes should be high. Further, pursuant to the noise restriction, the blowing noise should be small. Besides, the axial flow fan must be free from being easily damaged while being rotated in a high speed.

Since the blades of the axial flow fan are most important so as to design the axial flow fan to satisfy the limitations, the shape, the chord length and the pitch angle of each of the blades are principal design factors.

In order to satisfy the limitations, various axial flow fans are proposed.

In U.S. Pat. No. 4,569,631, there is proposed an axial flow fan wherein the leading edge of a fan blade has a certain amount of backward sweep angle at the root portion near the hub and a certain amount of forward sweep angle at the tip portion near the band and pitch angles are defined along the radial positions. In U.S. Pat. No. 4,684,324, there is proposed an axial flow fan wherein with respect to the median line of each of the blades that is obtained by joining the points circumferentially equidistant from its leading edge and its trailing edge, a backward sweep angle is formed at the hub side of the blade, a forward sweep angle is formed at the radially outer side of the blade, and a position at which the sweep angle changes from a backward sweep angle to a forward sweep angle, its blade length and its pitch angle are defined. In U.S. Pat. No. 5,273,400, there is proposed an axial flow fan wherein its median sweep angle changes from a backward sweep angle to a forward sweep angle along a outwardly radial direction and its blade length, its pitch angle and its chamber angle are defined. In U.S. Pat. No. 5,393,199, there is proposed an axial flow fan wherein the median sweep angle is a forward sweep angle all along the outward radial direction, the sweep angle does not exceed 15° at the outer end of the blade, a region in which a leading edge line and a trailing edge line are parallel to a radial line exists, and the chord length decreases after it increases along the outward radial direction.

However, the above-described axial flow fans may improve the blowing efficiencies and reduce noises to a certain degree, but their blowing efficiencies are not improved sufficiently due to excessive sweep angle increases and cracks may be generated at their roots.

SUMMARY OF THE INVENTION

Accordingly, the present invention has been made keeping in mind the above problems occurring in the prior art, and an object of the present invention is to provide an axial flow fan, improving the blowing efficiency and reducing noise by harmonizing the design factors, such as the sweep angle of the fan, the curvatures of the leading and trailing edge and the pitch angles.

In order to accomplish the above object, the present invention provides an axial flow fan, comprising a hub, a plurality of blades extending radially outwardly from the hub, and an outer band surrounding peripheral ends of the blades, wherein the median sweep angle of each blade increases gradually from 0° along the outward radial direction, the leading sweep angle of each blade starts from an angle of less than 0°, increases gradually and terminates at an angle of more than 40°, the trailing sweep angle of each blade increases along the outward radial direction after it decreases from an angle of more than 0° along the outward radial direction, the chord length of each blade gradually increases along the outward radial direction, and the pitch angle of each blade gradually decreases along the outward radial direction.

According to another embodiment, a point at which the leading sweep angle of each blade changes from a negative angle to a positive angle may be situated within the radially inward 50% of a length of the blade.

According to a further embodiment, a skew angle of a radial line passing through a radially outer end of a median line of each of the blades may be less than a skew angle of a radial line passing through a radially inner end of the leading edge line of each of the blades.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Prior requirements in an axial flow fan used in conjunction with an automobile are a high efficiency characteristic and a low noise characteristic. In order to allow the axial flow fan to have these characteristics, three principal design factors of the sweep angles, the chord lengths and the pitch angles of each of the blades should be harmonized.

The sweep angle S of the blade is a factor that represents the sweeping degree of the blade. Since the sweep angle S affects the blowing efficiency and noise, priority is given to it in design. When the other conditions are identical, the greater the sweep angle S is, the less the noise and the blowing efficiency are. As a result, when the sweep angle S is increased under the same conditions, noise is reduced, but the amount of consumed power is increased and the strength of the fan should be increased because high-speed rotation is required.

The chord length of the blade is a factor that represents the width of the blade in the direction of rotation. The chord length affects the amount of airflow and efficiency. That is, under the same conditions, the greater the chord length is, the greater the amount of airflow and efficiency become. However, in a range more than a certain amount of chord length, the greater the chord length is, the less the amount of airflow and efficiency become.

The pitch angle $\alpha$ of the blade is a factor that represents the gradient of the blade. When the pitch angle $\alpha$ is increased, the amount of airflow and efficiency are increased and noise is reduced. However, when the pitch angle $\alpha$ is more than a certain amount, separation occurs on the negative pressure surface, thus reducing the amount of airflow and efficiency rapidly and increasing noise.

As described above, the above three factors affect major characteristics of an axial fan, such as the amount of airflow, efficiency and noise. The required characteristics of an axial fan are satisfied when the factors are harmonized.

An axial flow fan according to the present invention is designed to have a high efficiency characteristic and a low noise characteristic by harmonizing the design factors.

Figure 1:
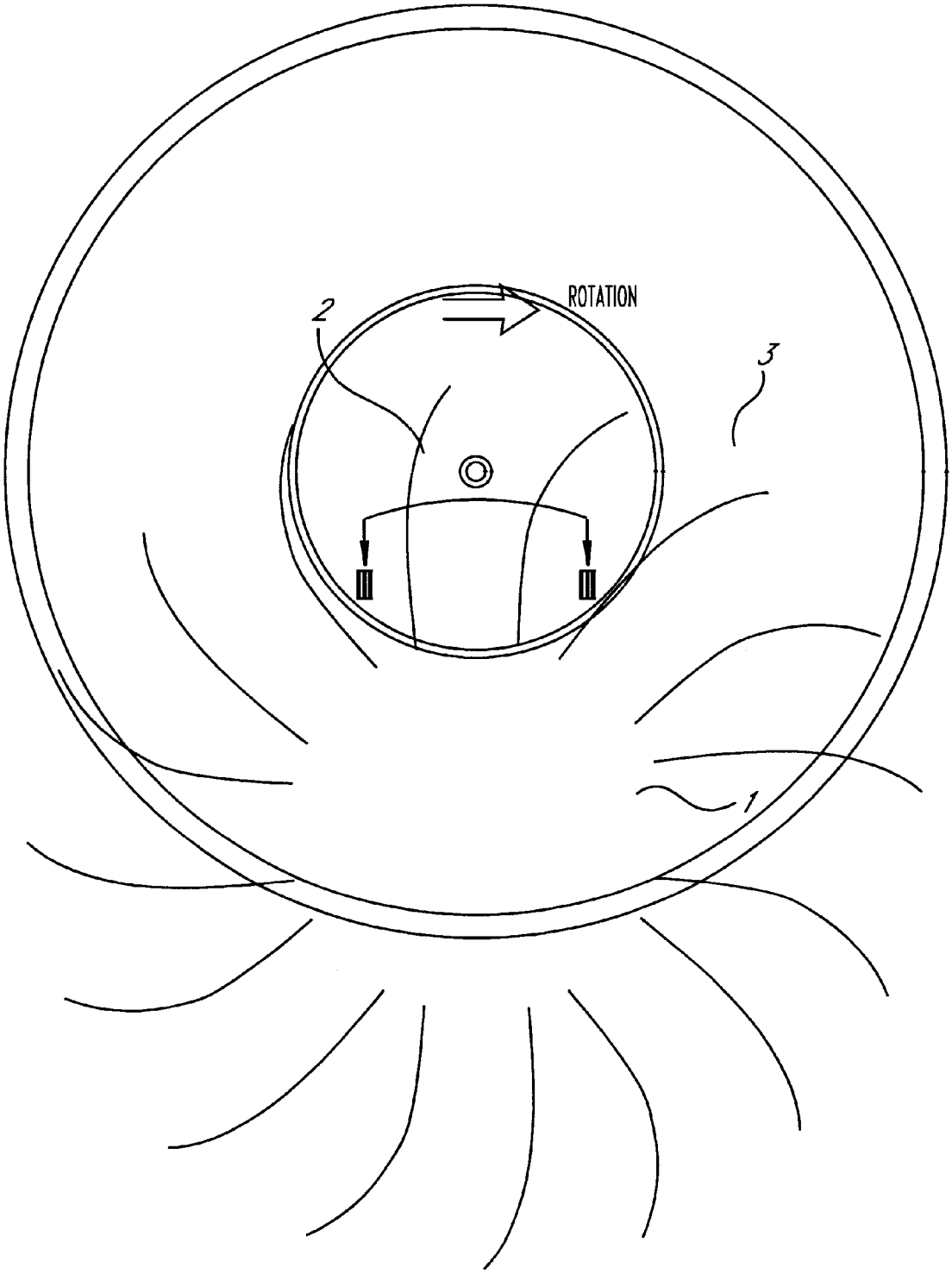
FIG. 1 is a front view showing an axial flow fan according to the present invention.

FIG. 1 is a plan view showing the axial flow fan. As shown in this drawing, the axial flow fan of the present invention comprises a central hub 1, a plurality of blades 2 extending radially outwardly from the hub 1, and an outer band 3 to which the peripheral ends of the blades 2 are fixed.

Figure 2:
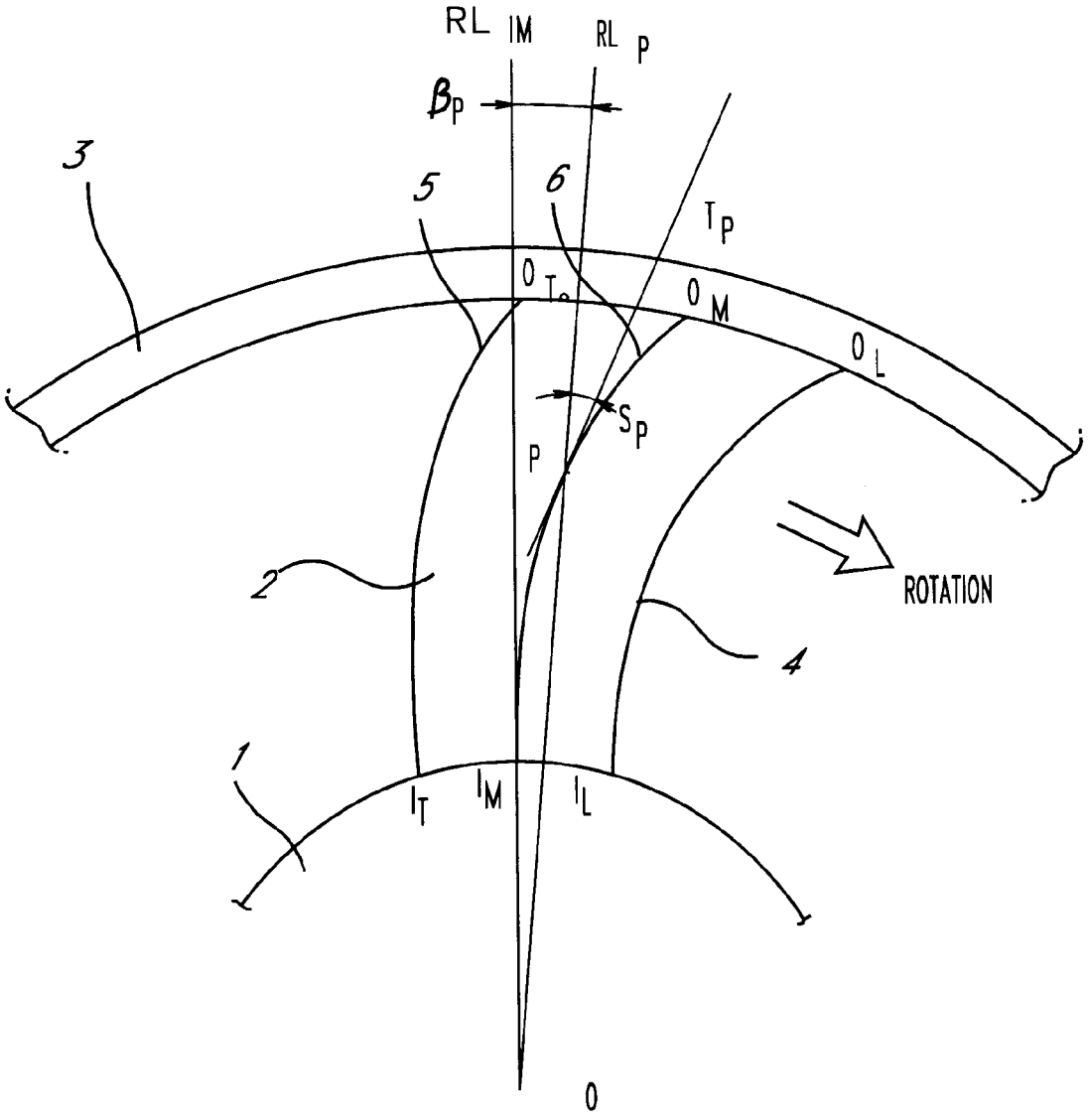
FIG. 2 is a partial enlarged view of FIG. 1.
Figure 3:
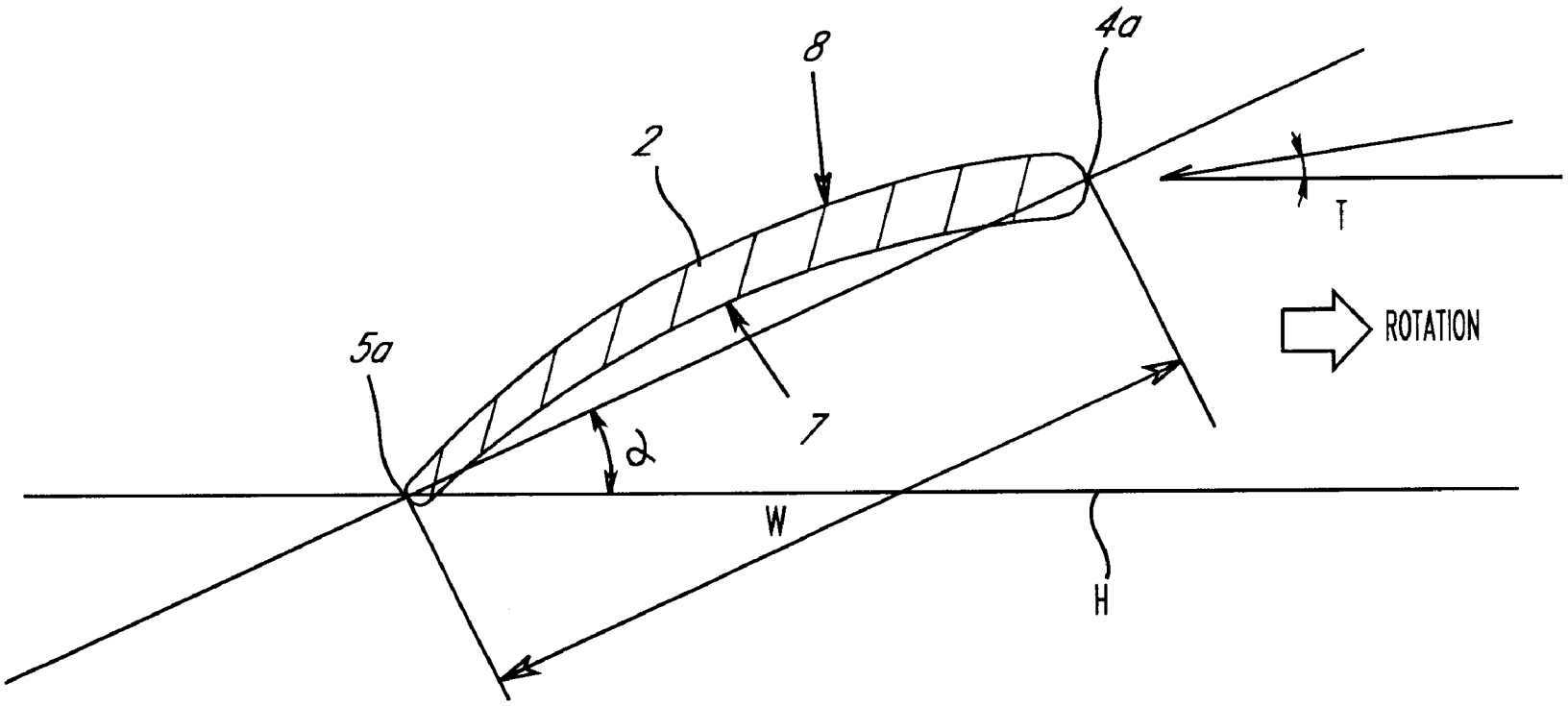
FIG. 3 is a cross section taken of along line III—III of FIG. 1.

Before the axial flow fan is described in more detail, the terms used in the description are defined first, referring to FIGS. 2 and 3.

When as shown in FIG. 3, a leading edge 4*a* and a trailing edge 5*a* are respectively defined as a frontmost point and a rearmost point of a blade cross section with regard to the direction of rotation, as shown in FIG. 2, a leading edge line 4 and a trailing edge line 5 may be defined as a line joining radially all the leading edges 4*a* and a line radially joining all the trailing edges 5*a*. As shown in FIG. 2, a median line 6 is defined as a line obtained by joining the points that are circumferentially equidistant from the leading edge line 4 and the trailing edge line 5.

Meanwhile, a sweep angle S ($S_P$, $S_L$ and $S_T$) is defined as the interval angle between a tangent $T_P$ passing through a point in the above-defined lines (the median line 6, the leading edge line 4 and the trailing edge line 5) and a radial line $RL_P$ passing through the center O of the hub 1, and a skew angle $\beta_P$ is defined as an interval angle between a radial line $RL_{IM}$ joining the center of the hub 1 and the inner end $I_M$ of the median line 6 and a radial line $RL_P$ passing through a point in the median line. In measurement of the above angles, the angle measured along the direction of rotation is given a plus sign, while the angle measured along the opposite direction of rotation is given a minus sign.

In addition, as shown in FIG. 3, a pitch angle $\alpha$ is defined as the interval angle between the line joining the leading edge 4*a* and the trailing edge 5*a* and the line lying in the direction of rotation, and a chord length W is defined as the distance between the leading edge 4*a* and the trailing edge 5*a*. Further, as shown in FIG. 5, a blade length ($R_0$-$R_I$) is defined as the distance between the inner end and the outer end of the blade, that is, the difference between the radius $R_0$ with regard to the outer end of the blade and the radius $R_I$ with regard to the inner end of the blade, and a position P of the blade is defined as a difference ($R_P$-$R_I$) between a radius RP with regard to the point P and the radius $R_I$ with regard to the inner end of the blade.

Figure 4:
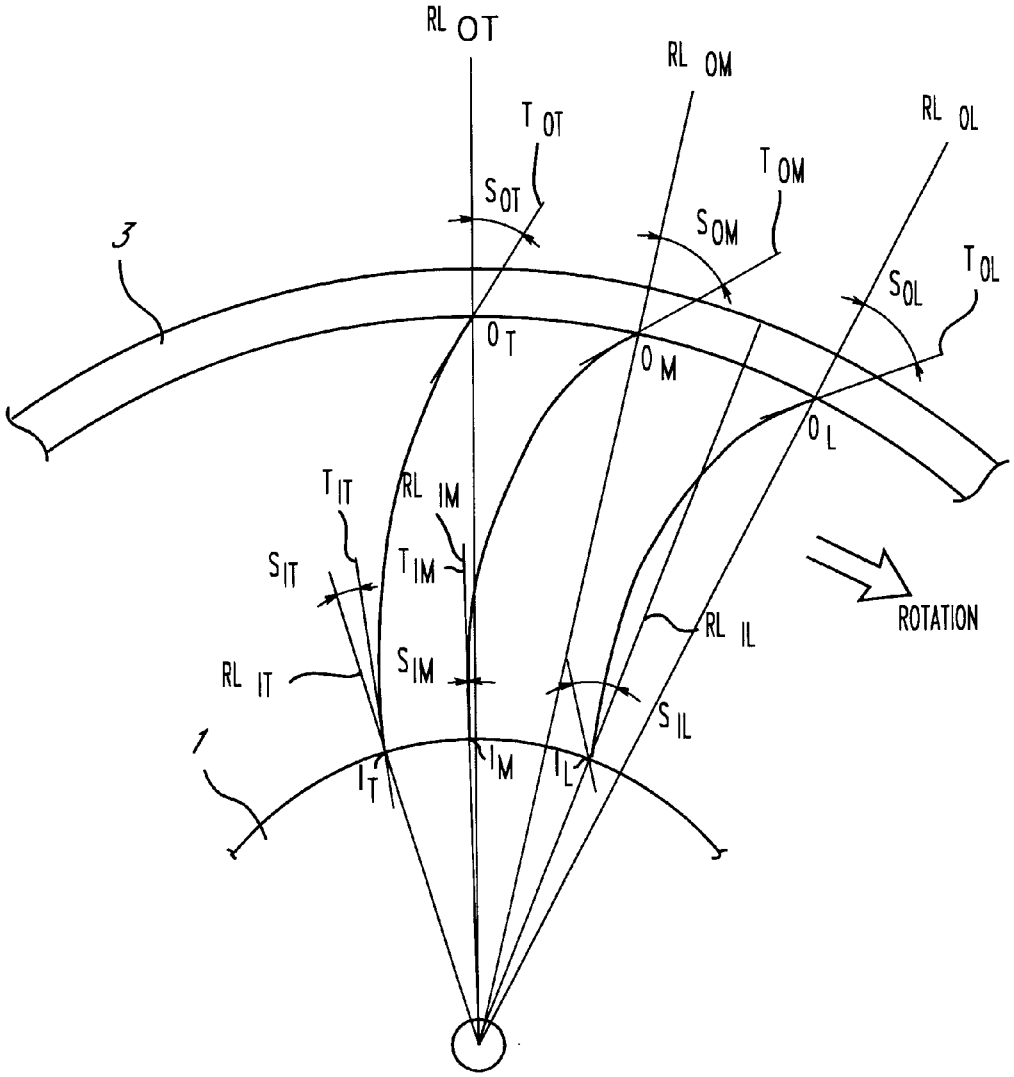
FIG. 4 is a partial enlarged view showing the sweep angle characteristics according to the present invention.

In the axial flow fan of the present invention, the sweep angle S of the blade 2 should take a proper value so as to prevent the reduction of efficiency and the reduction of noise. That is, the sweep angle S decreases in the portion near the hub 1 so as to improve efficiency and reinforce the strength of the blade 2, while the sweep angle S of the blade 2 increases in the portion near the outer band 3 so as to reduce noise. In more detail, a median sweep angle $S_P$ defined as the interval angle between a tangent $T_P$ passing through a point P in the median line 6 and a radial line passing through the center O of the hub 1 is about zero in the portion near the inner end $I_M$ of the median line 6 and increases in the portion near the outer end $O_M$ of the median line 6. The leading sweep angle $S_L$, defined like the median sweep angle, has a minus value at the inner end $I_L$ of the leading edge line 4 (that is, $S_{IL}<0°$ in FIG. 4), increases along the leading edge line 4 and, finally, has at the outer end $O_L$ of the leading edge line 4 a value greater than the value of the median sweep angle at the outer end $O_M$ of the median line 6 (that is, $S_{OL}>S_{OM}$ in FIG. 4). In such a case, the leading sweep angle $S_{OL}$ at the outer end $O_L$ of the leading edge line 4 is made to be more than 40°, thereby reducing noise greatly. The trailing sweep angle $S_T$, defined like the median sweep angle, has a plus value at the inner end $I_T$ of the trailing edge line 5 (that is, $S_{IT}>0$ in FIG. 4), decreases gradually along the trailing edge line 5 to a certain point, and, finally, increases from this point to the outer end $O_T$ of the trailing edge line 5.

Figure 6:
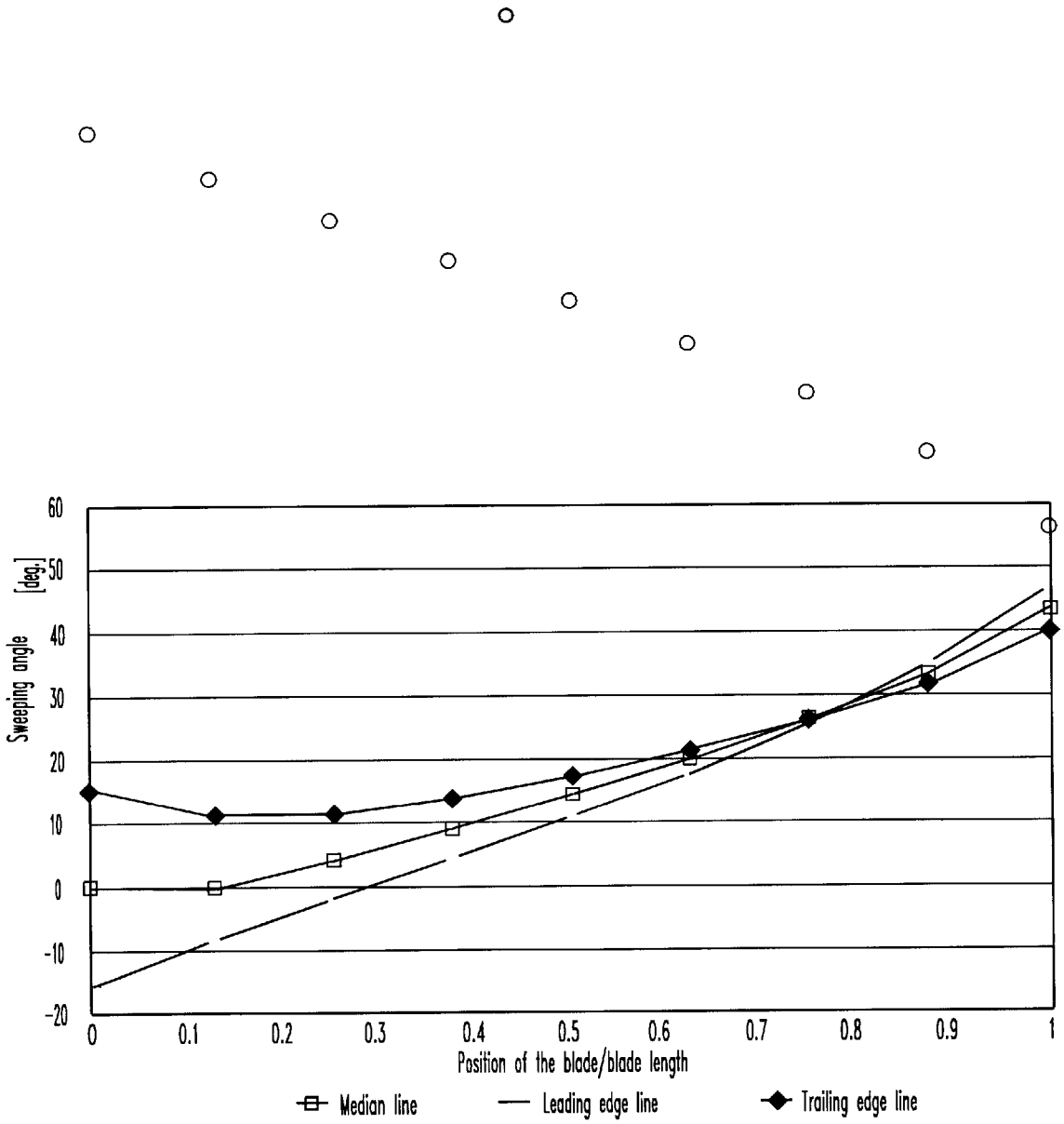
FIG. 6 is a graph showing variation in sweep angle with regard to ratio of the position in the blade to the chord length.

The graph of FIG. 6 illustrates variations of sweep angles of the blades of the present invention that prevents the reduction of efficiency and reduces noise.

Figure 5:
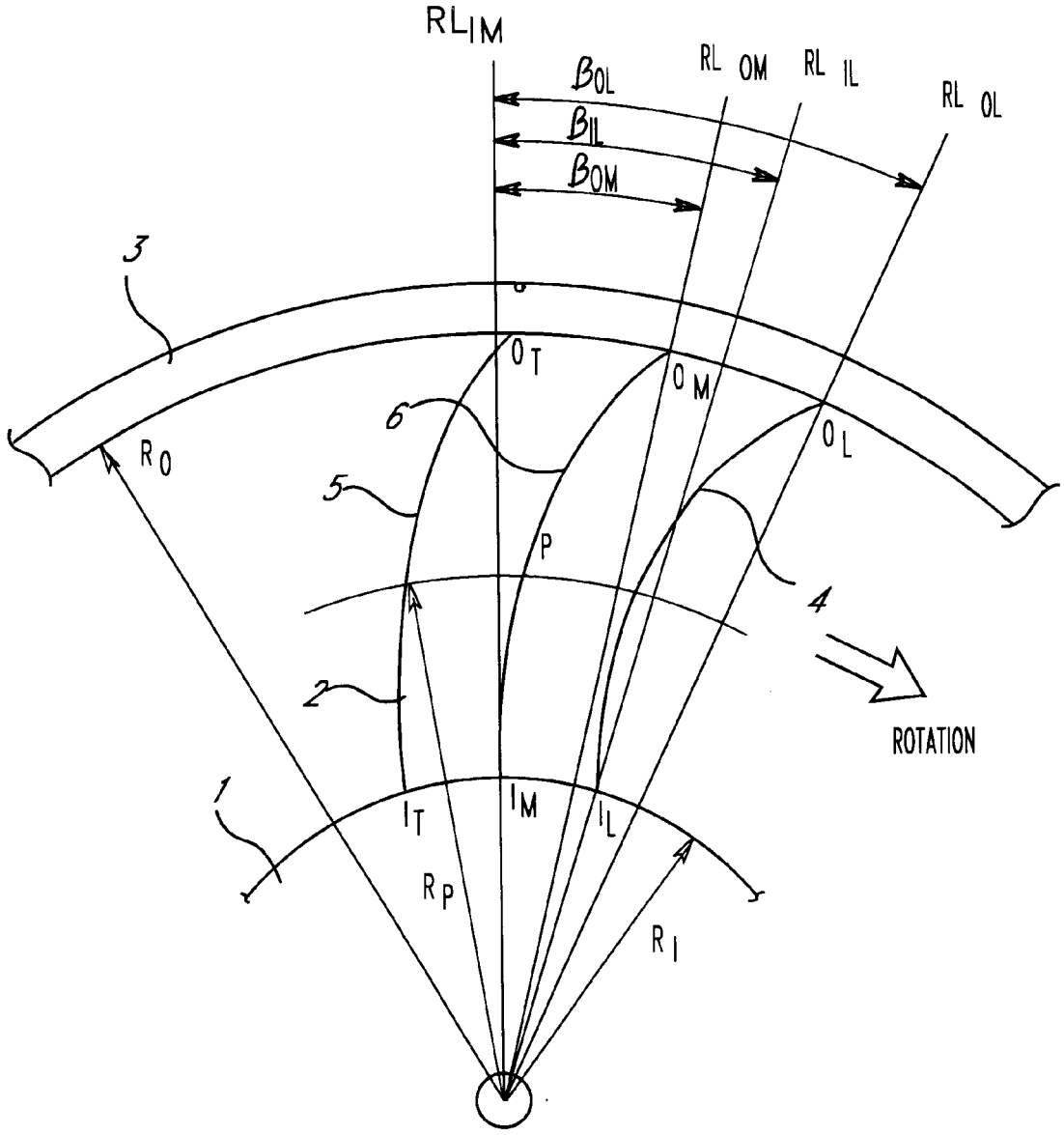
FIG. 5 is a partial enlarged view showing the skew angle characteristics according to the present invention.

In the mean time, FIG. 5 shows a skew angle characteristic of the blade of the axial flow fan according to an embodiment of the present invention.

Since the efficiency of the fan may be reduced when the blade 2 is excessively skewed, the skew angle $\beta_{OM}$ at the outer end $O_M$ of the median line 6 is made to be less than the skew angle $\beta_{IL}$ at the inner end $I_L$ of the leading edge line 4. On the other hand, since noise is increased when skew angles in the leading edge line 4 are excessively small, the skew angle $\beta_{OL}$ at the outer end $O_L$ of the leading edge line 4 is made to be greater than the skew angle $\beta_{IL}$ at the inner end $I_L$ of the leading edge line 4 (that is, $\beta_{OL}>\beta_{IL}$). As known from FIGS. 4 and 6 and the below-described table 1, the point at which a leading sweep angle SL changes from a minus value to a plus value is made to be situated within radially inward 50% of the blade length (R0-R1) from the inner end IL of the leading edge line 4, thus preventing the reduction of efficiency due to abrupt increase in sweep angle at the portion near the outer end of the blade.

Figure 7:
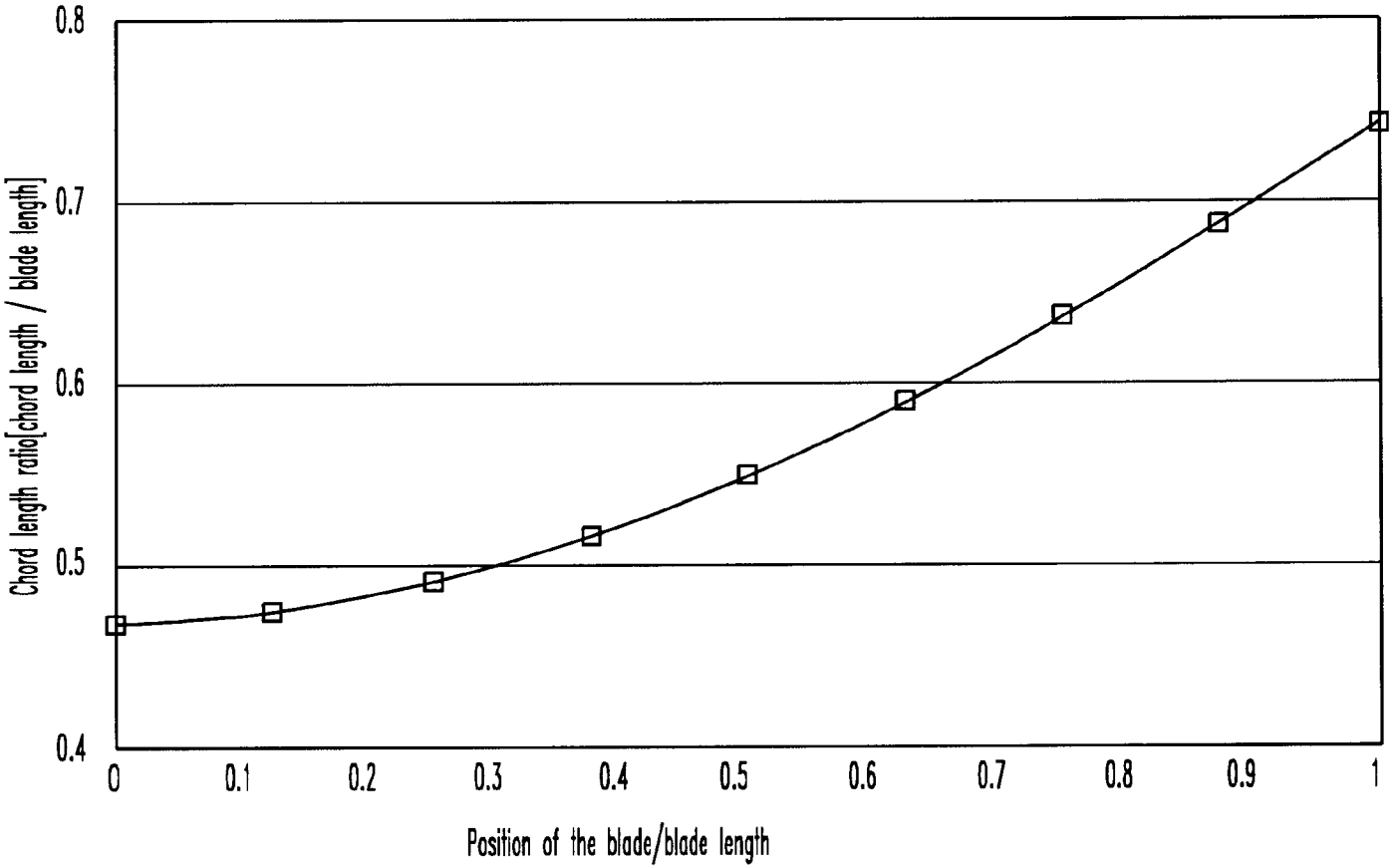
FIG. 7 is a graph showing variation in chord length ratio with regard to ratio of the position in the blade to the chord length.

FIG. 7 is a graph showing variations in chord length of the blade 2 according to positions in the radial direction. In this graph, a chord length ratio $W_P/(R_0-R_I)$ indicated in the vertical axis represents the ratio of the chord length to the blade length. As shown from this graph, in the axial flow fan, the further a position under consideration is moved to the radial direction from the hub 1, the greater the chord length W becomes. The graph of FIG. 7 is concerned with the axial flow fan having seven blades. As the number of blades is increased, the chord length ratio $W_P/(R_0-R_I)$ is decreased, while as the number of the blades is decreased, the chord length ratio $W_P/(R_0-R_I)$ is increased.

Figure 8:
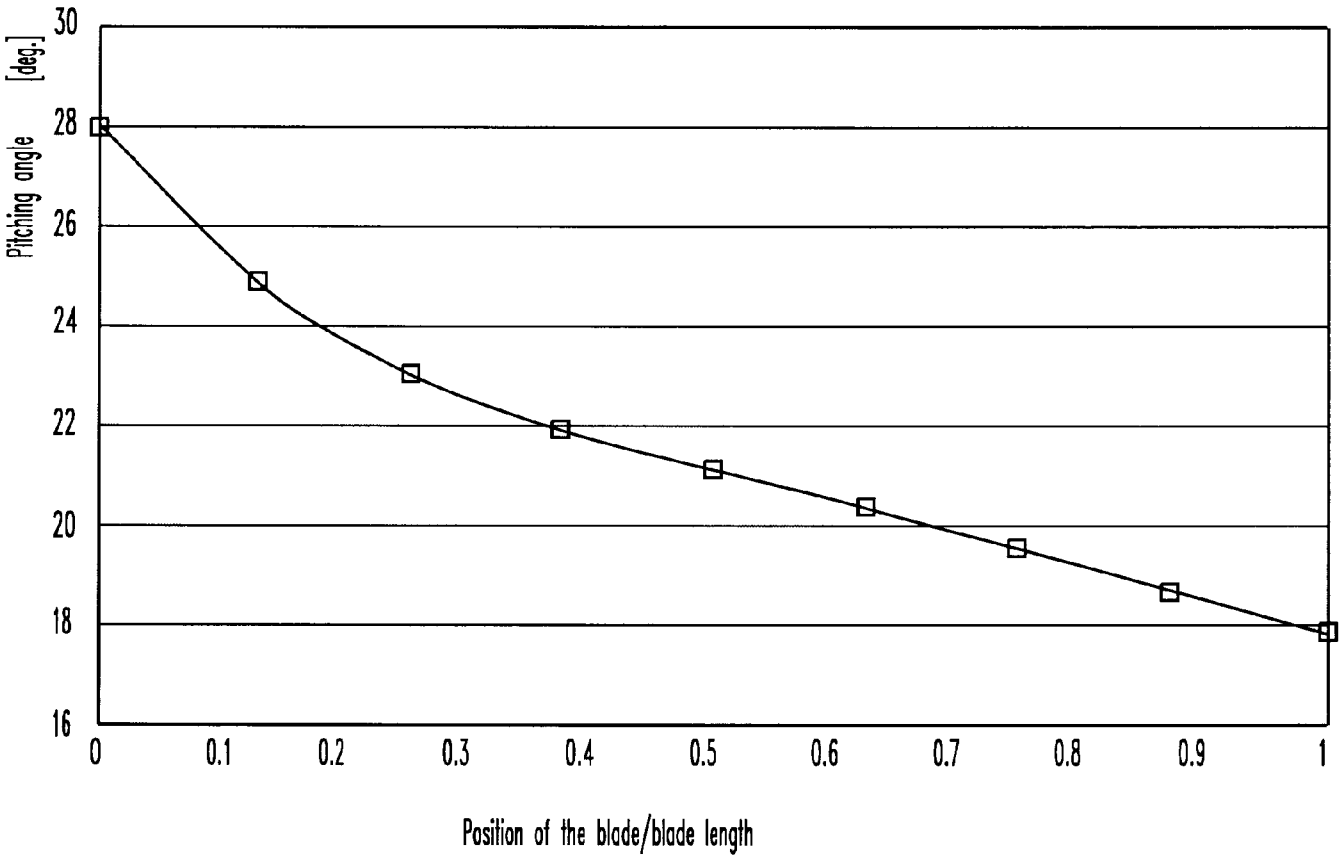
FIG. 8 is a graph showing variation in pitch angle with regard to ratio of the position in the blade to the chord length
Figure 1:
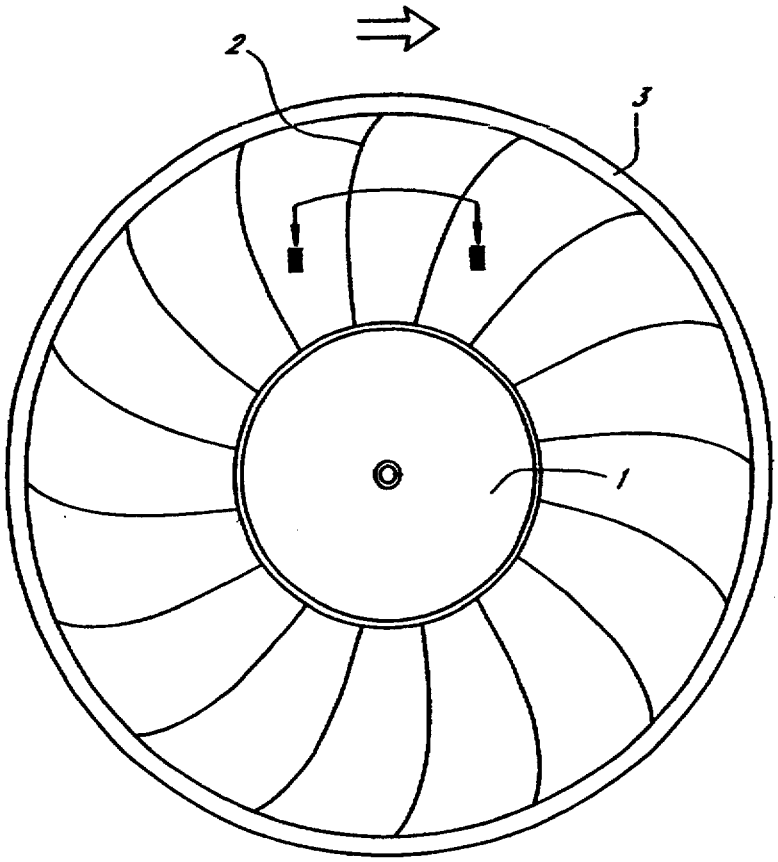
Figure 2:
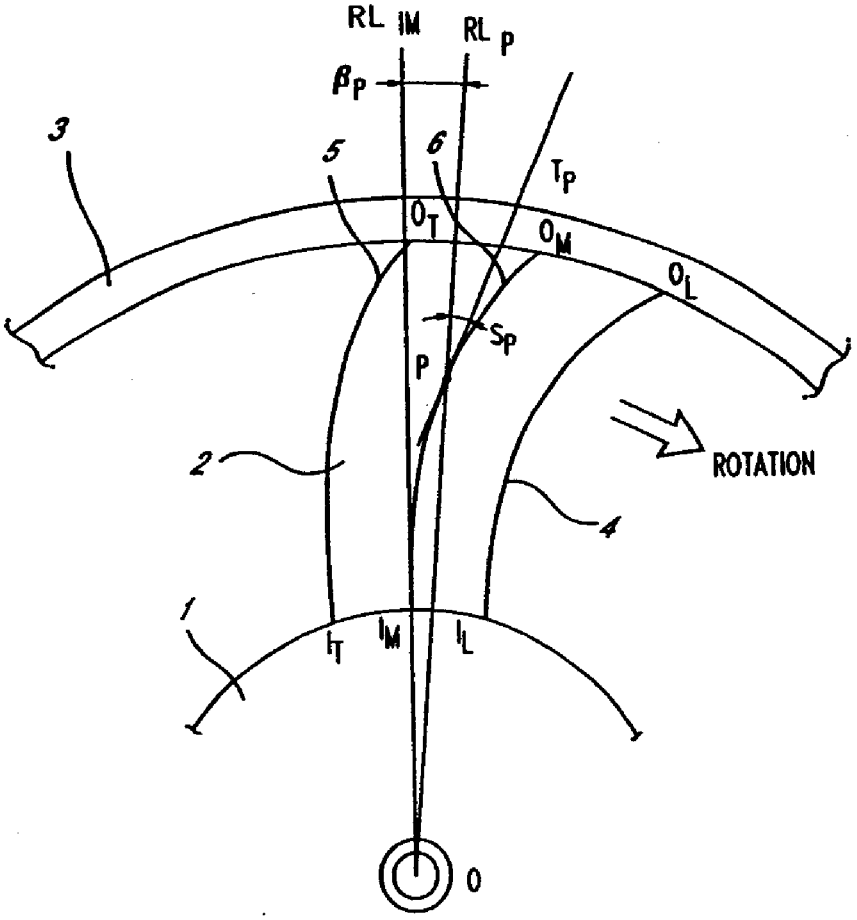
Figure 4:
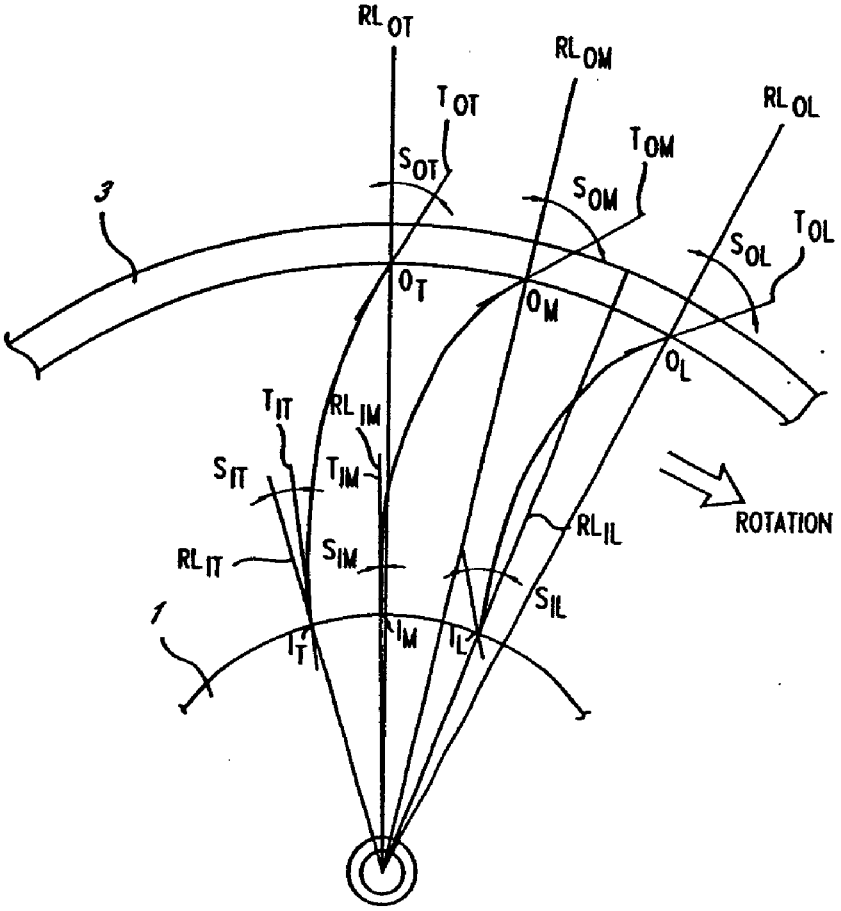
Figure 5:
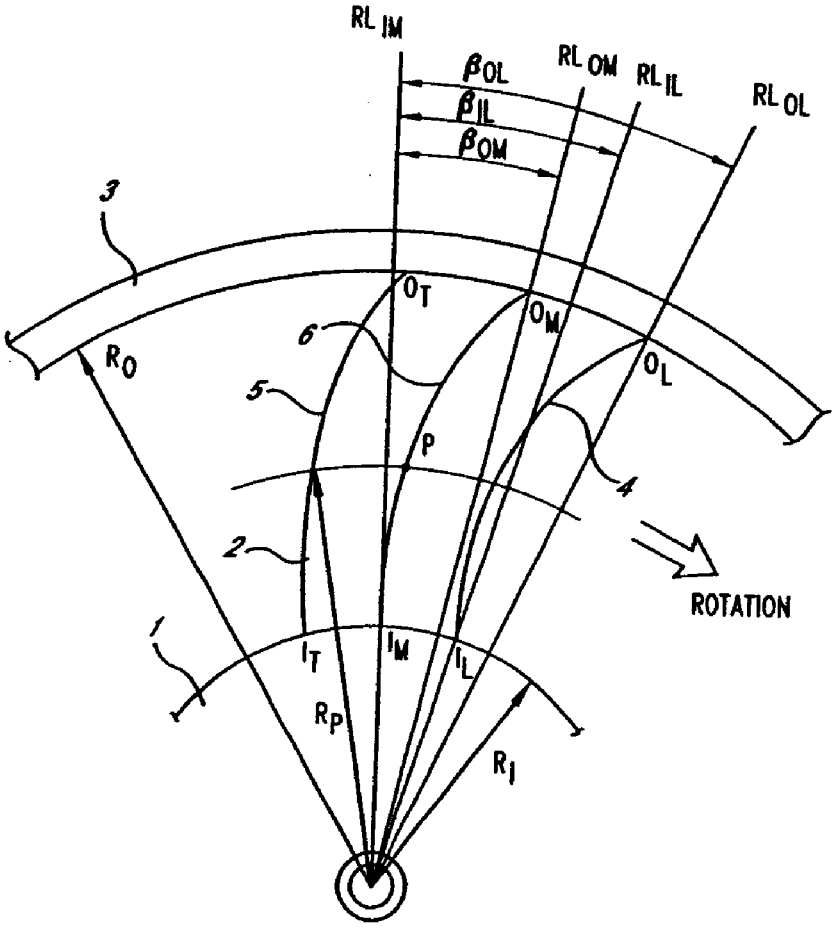
Figure 6:
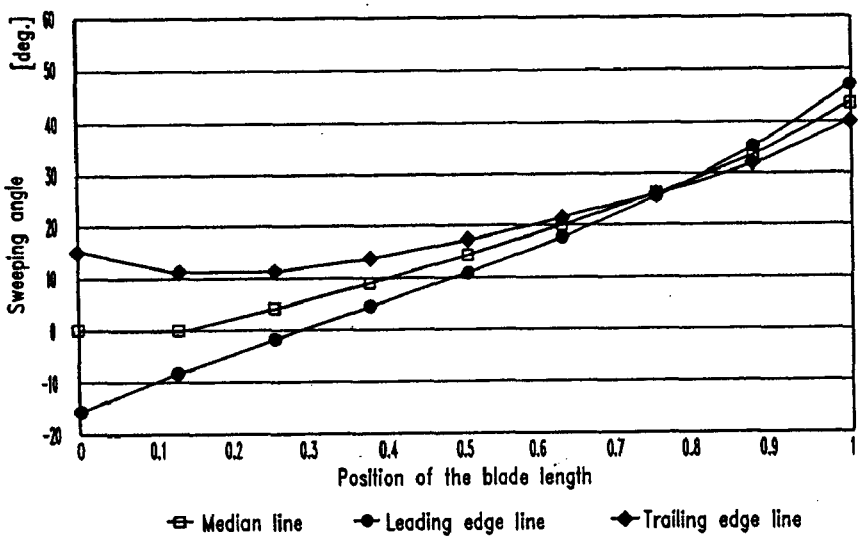

FIG. 8 is a graph showing variations in pitch angle with regard to positions in the blade in the axial flow fan of the present invention.

The axial flow fan serves to move air from the front of the blades to the rear of the blades. Such the movement of air is generated by pressure increase on the positive pressure surface due to the rotation of the blades. Since according to the rotation of the blades, positive pressure is generated on the positive pressure surface and negative pressure is generated on the negative pressure surface, there is required rotating force, that is, the driving force of a motor that may overcome the difference between pressures on the positive and negative pressure surfaces. It may be deduced from this fact that as the difference between pressures on the positive and negative pressure surfaces is reduced, the rotating force required to drive the fan is reduced, thus improving the efficiency of the axial flow fan.

In the mean time, when the pitch angle a is excessively large, the difference between pressures on the positive and negative pressure surfaces is increased by the separation generated on the negative surface, so that the efficiency of the fan is reduced. On the other hand, when the pitch angle $\alpha$ is excessively small, high-speed rotation is needed so as to generate the required amount of airflow, so that the noise of the fan is increased.

In the axial flow fan, as shown in FIG. 8, the pitch angle $\alpha$ of the fan is decreased along the outward direction of rotation. This is designed under the consideration that the speed of rotation is faster at the outer end portion of the blade and the introducing angle T of air is small, although the axial flow fan is rotated at a single body. The pitch angle $\alpha$ of the blade is preferably set to be less than 20° at an outer end of each blade.

Table 1 shows numerical values with regard to the principal design factors for each of the blades of the axial flow fan according to an embodiment of the present invention. Table 1 indicates sweep angles S, chord lengths W and pitch angles $\alpha$ according to the positions of the blade with regard to the blade lengths.

The design factors are explained in more detail as follows. As known in Table 1, the median sweep angle $S_m$ of the blade increases from 0° to 43.6° along the outward radial direction, the leading sweep angle $S_L$ increases from −15.6° to 47.3° along the outward radial direction, and the trailing sweep angle $S_T$ of the blade increases to 40.3° along the outward radial direction after it decreases from 15.2° to 11.3° along the outward radial direction as far as the position where the position in the blade per the blade length is 0.125.

TABLE 1

| Position in Blade/ Blade length ($R_P/(R_0-R_1)$) | Median sweep angle ($S_M$) | Leading sweep angle ($S_L$) | Trail sweep angle ($S_T$) | Chord length/ Blade length ($W_P/(R_0-R_1)$) | Pitch angle ($\alpha$) |
|---|---|---|---|---|---|
| 0.000 | 0.0 | −15.6 | 15.2 | 0.47 | 28.0 |
| 0.125 | 0.0 | −8.4 | 11.3 | 0.47 | 24.9 |
| 0.250 | 4.1 | −1.7 | 11.5 | 0.49 | 23.1 |
| 0.375 | 9.1 | 4.6 | 14.0 | 0.52 | 21.9 |
| 0.500 | 15.6 | 11.0 | 17.5 | 0.55 | 21.1 |
| 0.625 | 20.3 | 18.0 | 21.6 | 0.59 | 20.4 |
| 0.750 | 26.4 | 25.9 | 26.2 | 0.64 | 19.5 |
| 0.875 | 33.7 | 35.4 | 32.0 | 0.69 | 18.6 |
| 1.000 | 43.6 | 47.3 | 40.3 | 0.74 | 17.8 |

In more detail, the median sweep angle of the blade increases gradually from 0° to 43.6° along the outward radial direction so as to improve the efficiency of the fan and the strength of the blade. Additionally, the leading sweep angle $S_L$ starts from −15.6°, increases and changes to the positive value prior to the point at which the position in the blade per the blade length is 0.375 and terminates to 47.3° more than 43.6° of the median sweep angle at the same position, thereby reducing noise at the outer ends of the blades.

The chord length ratio $W_P/(R_0-R_I)$ represents the chord length W along the direction of rotation and affects the amount of airflow and the efficiency of the fan. The chord length ratio $W_P/(R_0-R_I)$ is designed to gradually increase from 0.47 at the inner end $R_I$ of the blade 2 to 0.74 at the outer end of the blade 2, thereby allowing the relatively high rotational speed outer end to be used effectively. This enlarges the amount of airflow and improves the efficiency of the fan. Those chord length ratios $W_P/(R_0-R_I)$ are concerned with the axial flow fan having seven blades and vary with the number of the blades in the fan.

The pitch angle $\alpha$, as the gradient of the blades to the direction of rotation of the fan, that determines the incidence angle T of air is set to decrease toward the outer end of the blade under the consideration that the incidence angle T is decreased because the rotating speed of the blade becomes faster toward the outer end of the blade. Especially, since the pitch angle $\alpha$at the outer end of the blade is designed to be 17.8° not exceeding 20°, separation is suppressed, thereby harmonizing the amount of airflow, the efficiency of the fan and the reduction of noise.

Table 2 shows numerical values with regard to the principal design factors for each of the blades of the axial flow fan according to another embodiment of the present invention.

TABLE 2

| Position in Blade/ Blade length ($R_P/(R_0-R_1)$) | Median sweep angle ($S_M$) | Leading sweep angle ($S_L$) | Trail sweep angle ($S_T$) | Chord length/ Blade length ($W_P/(R_0-R_1)$) | Pitch angle ($\alpha$) |
|---|---|---|---|---|---|
| 0.000 | 0.0 | −15.6 | 15.2 | 0.47 | 26.3 |
| 0.125 | 0.0 | −8.4 | 11.3 | 0.47 | 25.8 |
| 0.250 | 4.1 | −1.7 | 11.5 | 0.49 | 25.4 |
| 0.375 | 9.1 | 4.6 | 14.0 | 0.52 | 24.6 |
| 0.500 | 15.6 | 11.0 | 17.5 | 0.55 | 23.4 |
| 0.625 | 20.3 | 18.0 | 21.6 | 0.59 | 21.9 |
| 0.750 | 26.4 | 25.9 | 26.2 | 0.64 | 20.1 |
| 0.875 | 33.7 | 35.4 | 32.0 | 0.69 | 17.5 |
| 1.000 | 43.6 | 47.3 | 40.3 | 0.74 | 15.3 |

The axial flow fan according to this embodiment has a relatively high rotational speed as compared with the axial flow fan concerned with Table 1. When compared with those of the axial flow fan of Table 1, the pitch angles are decreased somewhat in reverse proportion to the rotational speed of the fan, while the other factors of the median sweep angle, the leading sweep angle $S_L$, the trailing sweep angle $S_T$ and the chord length ratio are set to be the same.

As described above, the present invention provides an axial flow fan having a high efficiency and generating low noise because the sweep angle, the chord length and the pitch angle of each of the blades are designed to be harmonized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An axial flow fan, comprising a hub, a plurality of blades extending radially outwardly from the hub, and an outer band surrounding peripheral ends of the blades, wherein a median sweep angle of each blade increases gradually from 0° along the outward radial direction, a leading sweep angle of each blade starts from an angle of less than 0°, increases gradually and terminates at an angle of more than 40°, a trailing sweep angle of each blade increases along the outward radial direction after it decreases from an angle of more than 0° along the outward radial direction, a chord length of each blade gradually increases along the outward radial direction, and a pitch angle of each blade gradually decreases along the outward radial direction.

2. The fan according to claim 1, wherein a point at which said leading sweep angle of each blade changes from a negative angle to a positive angle is situated within the radially inward 50% of a length of the blade.

3. The fan according to claim 1, wherein a skew angle of a radial line passing through a radially outer end of a median line of each of said blades is less than a skew angle of a radial line passing through a radially inner end of the leading edge line of each of said blades.

4. The fan according to claim 1, wherein a skew angle of a radial line passing through a radially outer end of the leading edge line of each of said blades is greater than a skew angle of a radial line passing through a radially inner end of the leading edge line of each of said blades.

5. The fan according to claim 1, wherein a pitch angle at an outer end of each of said blades is less than 20°.

6. The fan according to claim 1, wherein said hub, said blades and said outer band are integrated into a single piece.

7. An axial flow fan, comprising a hub, a plurality of blades extending radially outwardly from the hub, and an outer band surrounding peripheral ends of the blades, wherein the blades are shaped and mounted in accordance with design factors described in the following table:

| Position in Blade/ Blade length ($R_P/(R_0-R_1)$) | Median sweep angle ($S_M$) | Leading sweep angle ($S_L$) | Trail sweep angle ($S_T$) | Chord length/ Blade length ($W_P/(R_0-R_1)$) | Pitch angle ($\alpha$) |
|---|---|---|---|---|---|
| 0.000 | 0.0 | −15.6 | 15.2 | 0.47 | 28.0 |
| 0.125 | 0.0 | −8.4 | 11.3 | 0.47 | 24.9 |
| 0.250 | 4.1 | −1.7 | 11.5 | 0.49 | 23.1 |
| 0.375 | 9.1 | 4.6 | 14.0 | 0.52 | 21.9 |
| 0.500 | 15.6 | 11.0 | 17.5 | 0.55 | 21.1 |
| 0.625 | 20.3 | 18.0 | 21.6 | 0.59 | 20.4 |
| 0.750 | 26.4 | 25.9 | 26.2 | 0.64 | 19.5 |
| 0.875 | 33.7 | 35.4 | 32.0 | 0.69 | 18.6 |
| 1.000 | 43.6 | 47.3 | 40.3 | 0.74 | 17.8 |

8. The fan according to claim 7, wherein a skew angle of a radial line passing through a radially outer end of a median line of each of said blades is less than a skew angle of a radial line passing through a radially inner. end of the leading edge line of each of said blades.

9. The fan according to claim 7, wherein a skew angle of a radial line passing through a radially outer end of the leading edge line of each of said blades is greater than a skew angle of a radial line passing through a radially inner end of the leading edge line of each of said blades.

10. The fan according to claim 7, wherein the number of said blades is seven.

11. The fan according to claim 7, wherein said hub, said blades and said outer band are integrated into a single piece.

12. An axial flow fan, comprising a hub, a plurality of blades extending radially outwardly from the hub, and an outer band surrounding peripheral ends of the blades, wherein the blades are shaped and mounted in accordance with design factors described in the following table:

| Position in Blade/ Blade length ($R_P/(R_0-R_1)$) | Median sweep angle ($S_M$) | Leading sweep angle ($S_L$) | Trail sweep angle ($S_T$) | Chord length/ Blade length ($W_P/(R_0-R_1)$) | Pitch angle ($\alpha$) |
|---|---|---|---|---|---|
| 0.000 | 0.0 | −15.6 | 15.2 | 0.47 | 26.3 |
| 0.125 | 0.0 | −8.4 | 11.3 | 0.47 | 25.8 |
| 0.250 | 4.1 | −1.7 | 11.5 | 0.49 | 25.4 |
| 0.375 | 9.1 | 4.6 | 14.0 | 0.52 | 24.6 |
| 0.500 | 15.6 | 11.0 | 17.5 | 0.55 | 23.4 |
| 0.625 | 20.3 | 18.0 | 21.6 | 0.59 | 21.9 |
| 0.750 | 26.4 | 25.9 | 26.2 | 0.64 | 20.1 |
| 0.875 | 33.7 | 35.4 | 32.0 | 0.69 | 17.5 |
| 1.000 | 43.6 | 47.3 | 40.3 | 0.74 | 15.3 |

13. The fan according t o claim 12, wherein a skew angle of a radial line passing through a radially outer end of a median line of each of said blades is less than a skew angle of a radial line passing through a radially inner end of the leading edge line of each of said blades.

14. The fan according to claim 12, wherein a skew angle of a radial line passing through a radially outer end of the leading edge line of each of said blades is greater than a skew angle of a radial line passing through a radially inner end of the leading edge line of each of said blades.

15. The fan according to claim 12, wherein the number of said blades is seven.

16. The fan according to claim 12, wherein said hub, said blades and said outer band are integrated into a single piece.

17. An axial flow fan, comprising a hub, a plurality of blades extending radially outwardly from the hub, and an outer band surrounding peripheral ends of the blades, wherein a trailing sweep angle of each blade increases along the outward radial direction after it decreases from an angle of more than 0° along the outward radial direction.

18. The fan according to claim 17, wherein a median sweep angle of each blade increases gradually from 0° along the outward radial direction.

19. The fan according to claim 17, wherein a leading sweep angle of each blade starts from an angle of less than 0°, increases gradually and terminates at an angle of more than 40°.

* * * * *

UNITED STATES PATENT AND TRADEMARK OFFICE

CERTIFICATE OF CORRECTION

PATENT NO. : 6,287,078 B1
DATED : September 11, 2001
INVENTOR(S) : Min et al.

It is certified that error appears in the above-identified patent and that said Letters Patent is hereby corrected as shown below:

Drawings,
Delete FIG. 1 and substitute therefor FIG. 1 as shown on the attached page.

Signed and Sealed this

Twenty-third Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,287,078 B1
DATED : September 11, 2001
INVENTOR(S) : Ok Ryul Min et al.

It is certified that error appears in the above-identified patent and that said Letters Patent is hereby corrected as shown below:

Title page should be deleted to appear as per attached title page.

The sheets of drawings consisting of Figures 2, 4, 5 and 6 should be deleted and substitute therefor, Figures 2, 4, 5, and 6, as shown on the attached pages.

Signed and Sealed this

Twenty-second Day of July, 2003

JAMES E. ROGAN
*Director of the United States Patent and Trademark Office*

(12) United States Patent
Min et al.

(10) Patent No.: US 6,287,078 B1
(45) Date of Patent: Sep. 11, 2001

(54) AXIAL FLOW FAN

(75) Inventors: Ok Ryul Min; Kyung Seok Cho, both of Taejon-si (KR)

(73) Assignee: Halla Climate Control Corp. (KR)

( * ) Notice: Subject to any disclaimer, the term of this patent is extended or adjusted under 35 U.S.C. 154(b) by 0 days.

(21) Appl. No.: 09/475,631

(22) Filed: Dec. 30, 1999

(30) Foreign Application Priority Data

Dec. 31, 1998 (KR) ..... 98-0064148
Dec. 7, 1999 (KR) ..... 99-0055565

(51) Int. Cl.[7] ..... F04D 29/38

(52) U.S. Cl. ..... 416/189; 416/238; 416/DIG. 2; 416/DIG. 5

(58) Field of Search ..... 416/169 A, 189, 416/192, 223 R, 238, 243, DIG. 2, DIG. 5

(56) References Cited

U.S. PATENT DOCUMENTS 4,548,548 * 10/1985 Gray, III ..... 416/189
4,569,631 * 2/1986 Gray, III ..... 416/189
4,684,324 * 8/1987 Perosino ..... 416/189
5,273,400 * 12/1993 Amr ..... 416/189
5,393,199 * 2/1995 Alizadeh ..... 416/189
5,996,685 * 12/1999 Alizadeh ..... 416/169 A

* cited by examiner

*Primary Examiner*—Christopher Verdier

(57) ABSTRACT

An axial flow fan is disclosed. The axial flow fan comprises a hub, a plurality of blades extending radially outwardly from the hub, and an outer band surrounding peripheral ends of the blades. The median sweep angle of each blade increases gradually from 0° along the outward radial direction. The leading sweep angle of each blade starts from an angle of less than 0°, increases gradually and terminates at an angle of more than 40°. The trailing sweep angle of each blade increases along the outward radial direction after it decreases from an angle of more than 0° along the outward radial direction. The chord length of each blade gradually increases along the outward radial direction. The pitch angle of each blade gradually decreases along the outward radial direction.

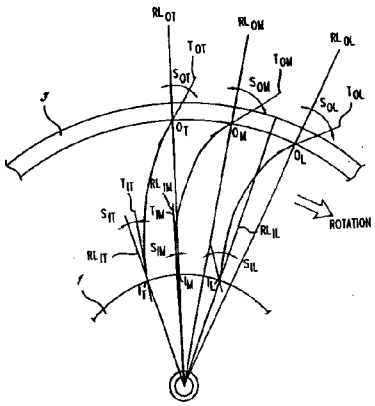

19 Claims, 8 Drawing Sheets